US005940974A

United States Patent [19]

Lee

[11] Patent Number: 5,940,974

[45] Date of Patent: Aug. 24, 1999

[54] COLLAPSIBLE SPOON FOR CANNED GOODS

[76] Inventor: Ji Cheng Lee, No. 635, Sec. 3, Chang Her Road, Ho Mei Town, Changhua Hsien, Taiwan

[21] Appl. No.: 09/097,458

[22] Filed: Jun. 15, 1998

[51] Int. Cl.[6] ..... A47J 43/28

[52] U.S. Cl. ..... 30/324; 30/322

[58] Field of Search ..... 30/322–328, 142, 30/147–150; D7/645

[56] References Cited

U.S. PATENT DOCUMENTS 4,615,120 10/1986 Newman ..... 30/324
4,788,862 12/1988 Fuller ..... 30/324 X
4,826,033 5/1989 Satoh ..... 30/324 X
5,705,212 1/1998 Atkinson ..... 30/324 X
5,735,050 4/1998 Hsieh ..... 30/324

*Primary Examiner*—Douglas D. Watts

[57] ABSTRACT

A collapsible spoon for a canned good includes a spoon member, an extension and a handle pivotally coupled between the spoon member and the extension. Two interlock devices may secure the handle to the spoon member and may secure the extension to the handle for maintaining the extension and the handle and the spoon member in longitudinal alignment. The interlock devices each includes an engagement of an ear with a recess and the other engagement of a projection with an orifice of the ear such that the spoon member and the handle and the extension may be solidly secured together.

3 Claims, 2 Drawing Sheets

COLLAPSIBLE SPOON FOR CANNED GOODS

BACKGROUND OF THE INVENTION

1. Field of the Invention

The present invention relates to a spoon, and more particularly to a collapsible spoon for canned goods.

2. Description of the Prior Art

A typical collapsible spoon is disclosed in U.S. Pat. No. 4,615,120 to Newman and comprises a handle pivotally coupled to a spoon body by force-fitted engagement, such that the handle may be easily folded relative to the spoon body when the utensil is used for stirring sticky soup, particularly for stirring the peanut butter or peanut soup.

The present invention has arisen to mitigate and/or obviate the afore-described disadvantages of the conventional collapsible spoons.

SUMMARY OF THE INVENTION

The primary objective of the present invention is to provide a collapsible spoon which includes three or more sections pivotally coupled together for allowing the spoon to be extended to a longer length.

The other objective of the present invention is to provide a collapsible spoon which includes three or more sections that may be solidly and pivotally secured and coupled together.

In accordance with one aspect of the invention, there is provided a collapsible spoon for a canned good, the spoon comprising a spoon body including a first end having a first recess formed therein and having a first projection extended inward of the first recess, a handle including a first end pivotally coupled to the first end of the spoon body at a live hinge for allowing the handle to be folded relative to the spoon body, the handle including a first ear extended from the first end of the handle for engaging with the first recess of the spoon body and for securing the handle to the spoon body and for maintaining the handle and the spoon body in longitudinal alignment, the first ear including an orifice for receiving the first projection of the spoon body and for further solidly securing the handle to the spoon body, and the handle including a second end having a second recess formed therein and having a second projection extended inward of the second recess, and an extension including a first end pivotally coupled to the second end of the handle at a live hinge for allowing the handle to be folded relative to the extension, the extension including a second ear extended from the first end of the extension for engaging with the second recess of the handle and for securing the handle to the extension and for maintaining the handle and the extension in longitudinal alignment, the second ear including an orifice for receiving the second projection of the handle and for further solidly securing the handle to the extension.

The projections each includes a free end having an enlarged size for solidly engaging with the ears and for further solidly securing the spoon body and the handle and the extension together. The projections each includes a frustum shaped structure having the free end of enlarged size for solidly engaging with the ears.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 4:
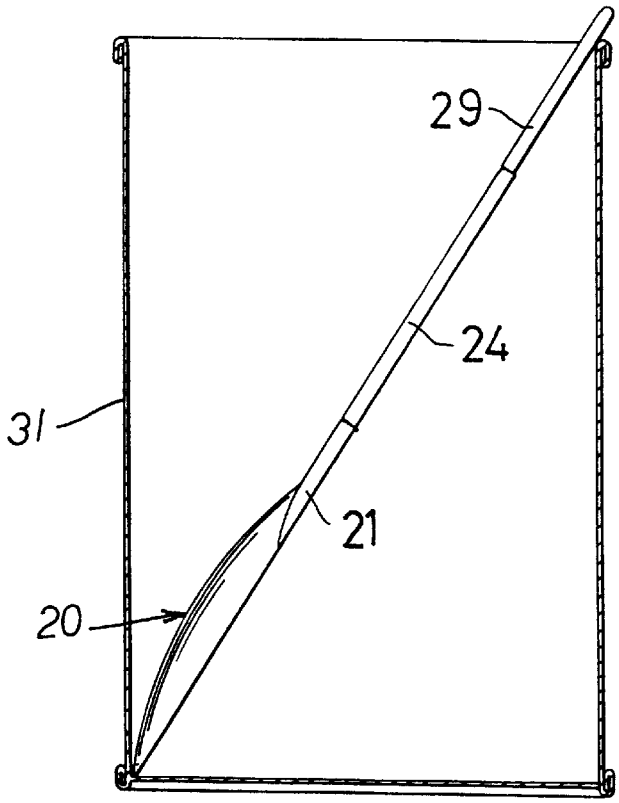
FIG. 4 is a cross sectional view of a can having the collapsible spoon engaged in the can.
Figure 5:
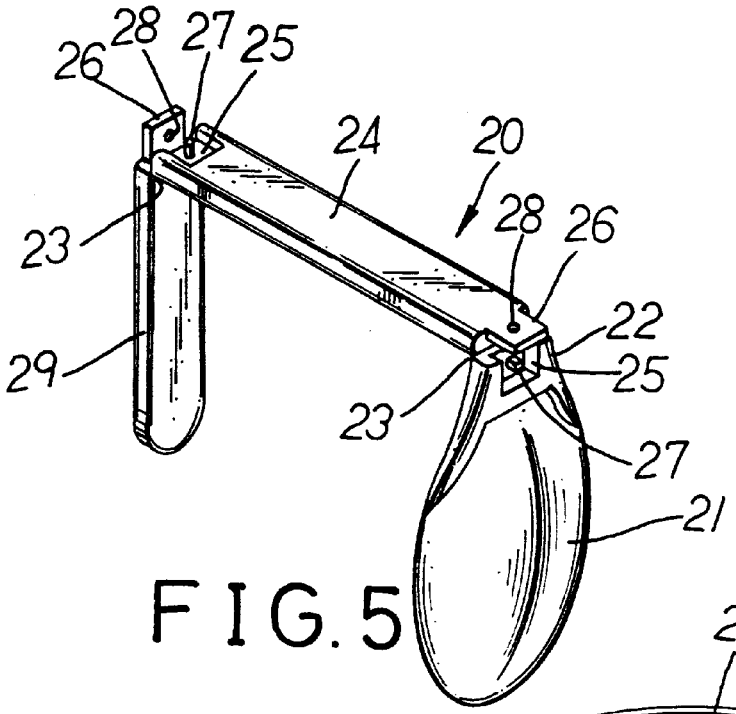
FIGS. 5, 6, 7 are perspective views illustrating the operation of the spoon.
Figure 6:
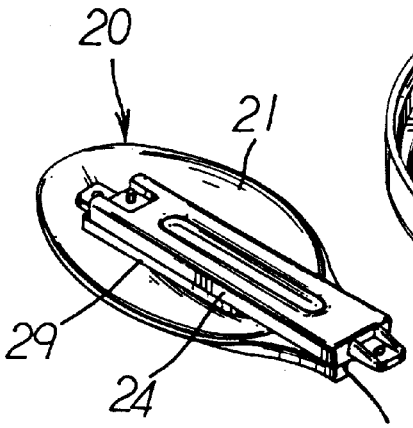
Figure 7:
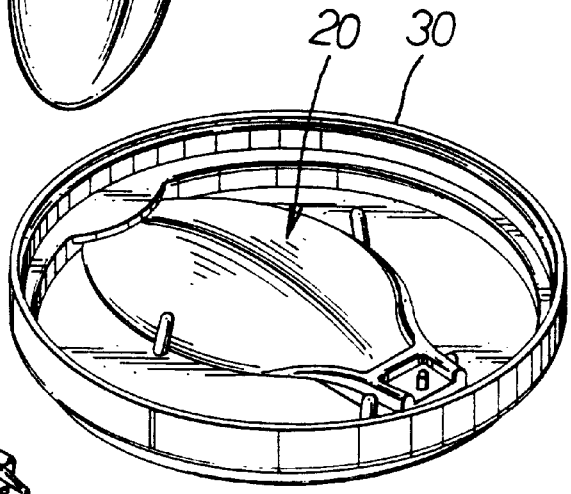
Figure 8:
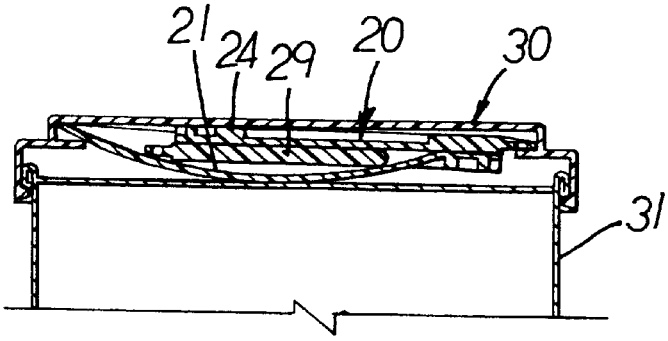
FIG. 8 is a partial cross sectional view of the can having the collapsible spoon engaged on top.

Referring to the drawings, and initially to FIGS. 1–5, a collapsible spoon in accordance with the present invention is generally designated by the reference numeral 20 and comprises a spoon body 21 including one end 22 pivotally coupled to a handle 24 at a live hinge 23, and an extension 29 pivotally coupled to the handle 24 at another live hinge 23, such that the spoon body 21 and the handle 24 and the extension 29 may be folded relative to each other to a compact size as shown in FIGS. 6–8, and such that the spoon 20 may be easily and suitably secured in a cap 30 which is to be secured on top of a can 31 (FIG. 8).

Figure 3:
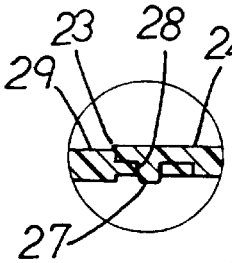
FIG. 3 is an enlarged partial cross sectional view of the collapsible spoon.

As best shown in FIGS. 3 and 5, the spoon body 21 includes a recess 25 formed in the one end 22 and a projection 27 extended inward of the recess 25. The handle 24 includes one end having an ear 26 extended therefrom for engaging in the recess 25 and for securing the handle 24 to the spoon body 21 and for maintaining the handle 24 and the spoon body 21 in longitudinal alignment. The ear 26 includes an orifice 28 for receiving the projection 27 and for further solidly securing the handle 24 to the spoon body 21. The handle 24 includes a recess 25 formed in the other end and a projection 27 extended inward of the recess 25. The extension 29 includes an ear 26 for engaging with the recess 25 and having an orifice 28 for receiving the projection 27 and for solidly securing the extension to the handle 24 and for solidly maintaining the handle 24 and the extension 29 in longitudinal alignment. The projections 27 will not be easily disengaged from the ears 26 when the spoon 20 is used for stirring the sticky object.

Figure 1:
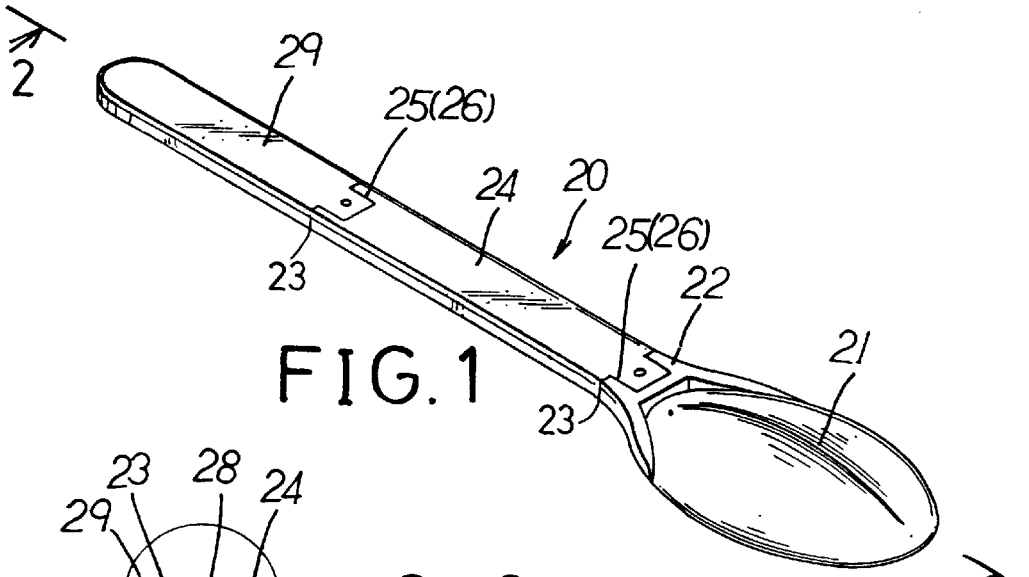
FIG. 1 is a perspective view of a collapsible spoon in accordance with the present invention.
Figure 2:
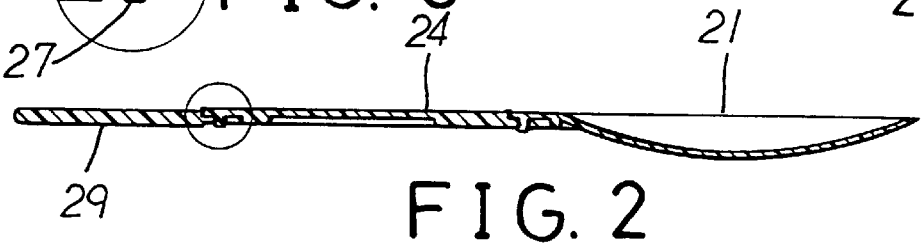
FIG. 2 is a cross sectional view taken along lines 2—2 of FIG. 1.

As best shown in FIG. 3, it is preferable that the projections 27 each includes a cylindrical structure having an enlarged free end or each includes a frustum shaped structure (FIG. 3) having the free end of greater size, such that the projections 27 may be solidly secured with the orifices 28 of the ears 26. As best shown in FIGS. 1, 2 and 4, after the spoon body 21 and the handle 24 and the extension 29 are extended in longitudinal alignment, the spoon 20 may include a size longer than the depth of the can 31 when the spoon 20 is disposed in a tilted manner such that the food contained in the can 31 may be easily fetched and cleaned with the spoon 20 by the user. The typical spoon includes two sections only such that, when extended, the spoon is shorter than the depth of the can and may not be used for clearly cleaning the food contained in the bottom of the can.

The engagement of the ears 26 with the recesses 25 of the spoon body 21 and of the handle 24 and the engagement of the projections 27 with the orifices 28 of the ears form two interlock devices and form a double security locking device for maintaining the spoon in longitudinal alignment. The engagements of the ears in the recesses and of the projections with the ears are preferably force-fitted engagements. Alternatively, the spoon body and the handle may each include an ear for engaging with the recesses that are formed in the handle and the extension respectively, such that the spoon body and the handle and the extension may also be secured together and maintained in longitudinal alignment.

Accordingly, the collapsible spoon in accordance with the present invention includes three or more sections pivotally coupled together for allowing the spoon to be extended to a longer length. In addition, the sections may be solidly and pivotally secured and coupled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A collapsible spoon for a canned good, said spoon comprising:

a spoon body including a first end having a first recess formed therein and having a first projection extended inward of said first recess, a handle including a first end pivotally coupled to said first end of said spoon body at a live hinge for allowing said handle to be folded relative to said spoon body, said handle including a first ear extended from said first end of said handle for engaging with said first recess of said spoon body and for securing said handle to said spoon body and for maintaining said handle and said spoon body in longitudinal alignment, said first ear including an orifice for receiving said first projection of said spoon body and for further solidly securing said handle to said spoon body, and said handle including a second end having a second recess formed therein and having a second projection extended inward of said second recess, and an extension including a first end pivotally coupled to said second end of said handle at a live hinge for allowing said handle to be folded relative to said extension, said extension including a second ear extended from said first end of said extension for engaging with said second recess of said handle and for securing said handle to said extension and for maintaining said handle and said extension in longitudinal alignment, said second ear including an orifice for receiving said second projection of said handle and for further solidly securing said handle to said extension.

2. The spoon according to claim 1, wherein said projections each includes a free end having an enlarged size for solidly engaging with said ears and for further solidly securing said spoon body and said handle and said extension together.

3. The spoon according to claim 2, wherein said projections each includes a frustum shaped structure having said free end of enlarged size for solidly engaging with said ears.

* * * * *